US006561769B1

(12) United States Patent
Tell

(10) Patent No.: US 6,561,769 B1
(45) Date of Patent: May 13, 2003

(54) FILTER AND MUFFLER FOR A VACUUM PUMP

(75) Inventor: Peter Tell, Akersberga (SE)

(73) Assignee: Piab AB, Taby (SE)

( * ) Notice: Subject to any disclaimer, the term of this patent is extended or adjusted under 35 U.S.C. 154(b) by 0 days.

(21) Appl. No.: 09/914,353

(22) PCT Filed: Jan. 21, 2000

(86) PCT No.: PCT/SE00/00134

§ 371 (c)(1),
(2), (4) Date: Aug. 27, 2001

(87) PCT Pub. No.: WO00/50776

PCT Pub. Date: Aug. 31, 2000

(30) Foreign Application Priority Data

Feb. 26, 1999 (SE) ..... 9900701

(51) Int. Cl.[7] ..... F04F 5/00
(52) U.S. Cl. ..... 417/151; 417/76
(58) Field of Search ..... 417/151, 174, 417/187, 189, 76, 181; 210/104, 137; 100/102; 73/421.5 R

(56) References Cited

U.S. PATENT DOCUMENTS 3,618,772 A * 11/1971 Dietrick ..... 210/104
3,765,247 A * 10/1973 Riggs ..... 73/421.5 R
4,597,716 A * 7/1986 Evenson ..... 417/181
4,861,232 A * 8/1989 Ise et al. ..... 417/76
5,032,260 A * 7/1991 Alzner ..... 210/137
5,205,717 A * 4/1993 Tell ..... 417/189
5,228,839 A * 7/1993 Peterson et al. ..... 417/174
5,623,870 A * 4/1997 Daniel ..... 100/102
5,624,239 A * 4/1997 Osika ..... 417/187
6,155,796 A * 12/2000 Schmalz et al. ..... 417/187
6,394,760 B1 * 5/2002 Tell ..... 417/174

* cited by examiner

*Primary Examiner*—Teresa Walberg
*Assistant Examiner*—L Fastovsky
(74) *Attorney, Agent, or Firm*—Young & Thompson

(57) ABSTRACT

Ejector type vacuum pump, comprising a rotationally symmetric ejector body (4) arranged in a house to be contained in a vacuum chamber (3) that extends axially and opens through a wall of the house, a dust filter (15) running concentrically about the eject body comprising a tube shaped, porous filter body, a frame circumferentially enclosing the filter body so that the filter body and frame form a self containing unit that extends substantially about the whole length of the ejector body to be axially fixed by a muffler (11) that is received in the opening of the vacuum chamber.

4 Claims, 1 Drawing Sheet

FILTER AND MUFFLER FOR A VACUUM PUMP

TECHNICAL FIELD

The present invention relates to a vacuum pump as defined in the preamble of claim 1, designed to cooperate with a dust filter and a muffler according to the invention, which is further described below.

More specifically, the subject invention relates to an ejector type vacuum pump, comprising a rotationally symmetric ejector body that is housed to be surrounded by a vacuum chamber that extends axially to open through the house wall. A dust filter runs concentric about the ejector body, and has a tube shaped, porous filter body that is circumferentially supported in a frame such that the filter body and the frame together form a self-containing, rotationally symmetric unit that runs substantially about the total length of the ejector body. A muffler comprising a rotationally symmetric body has an inner end that is shaped to be sealingly seated in the mouth of the vacuum chamber. The inner section of the muffler is dimensioned to receive and enclose the nozzle end of the ejector body, and tapers towards the mouth of the muffler. The muffler is inserted in the mouth of the vacuum chamber and engages the dust filter for axial fixation of the filter in the vacuum chamber.

OBJECT OF INVENTION

The object of the invention is to provide a vacuum pump of non-complex structure, and which by simplified structural measures may be incorporated in systems or assemblies where vacuum or negative pressure is desired for running a process.

Specifically, the vacuum pump of to the invention is designed to meet the object of facilitating assembly and disassembly in maintenance, when cleaning the dust filter or ejector, e.g. In industrial or otherwise polluted environments, service interrupts often is considered to be a technical and economic problem.

The object of invention is met in a vacuum pump as defined in the characterizing part of claim 1. The filter of claim 2 and muffler of claim 5 are separate elements of the invention, the common features of which is the structural adaptation to the rotationally symmetric ejector body, possibly of a multi stage configuration.

SUMMARY OF THE INVENTION

Briefly, the invention suggests a rotationally symmetric ejector body with one or several nozzles axially aligned and connected in series, and valve elements that are accommodated in the ejector body. The ejector is received in a vacuum chamber, formed in a house and opening axially in the house wall. The vacuum chamber is connected to a system, operated by negative pressure, and a compressed air supply is connected to the ejector so as to generate a negative pressure in the vacuum chamber through the ejector effect, as is known per se.

A separate attachable unit having a vacuum chamber and inlet for supply of compressed air, feeding the ejector, may form the vacuum pump house mentioned herein. Alternatively, the house is a vacuum chamber formed in the structure material of a system assembly, operated by negative pressure. The rotationally symmetric configuration of the ejector body allows a vacuum chamber to be formed in the structure material through boring and internal milling, so that a chamber of circular section is provided.

The vacuum chamber opens in a wall of the house or the structure material. The mouth of the vacuum chamber receives the circular sectioned muffler body, which occupies the annular space between the wall of the vacuum chamber and the nozzle end of the ejector body.

A dust filter is axially secured inwardly of the muffler. The filter runs concentric about the ejector body, substantially the whole length about the ejector body so that the forward end of the filter abuts the inner end of the muffler. The dust filter is a tube formed filter body of porous material. In the shown embodiment, the filter body is circumferentially enclosed by a frame having a perforated cylinder wall. Assembled, the filter and frame form a rotationally symmetric, self-containing unit that is manually attachable and detachable from the ejector body as the muffler is removed from the mouth of the vacuum chamber.

DRAWINGS

The invention is further disclosed below, reference being made to the accompanying drawings wherein FIG. 1 is a diagrammatic longitudinal section view of a house of the vacuum pump according to the invention, equipped with an ejector body, a muffler and a dust filter illustrated in broken lines;

DETAILED DESCRIPTION

Figure 1:
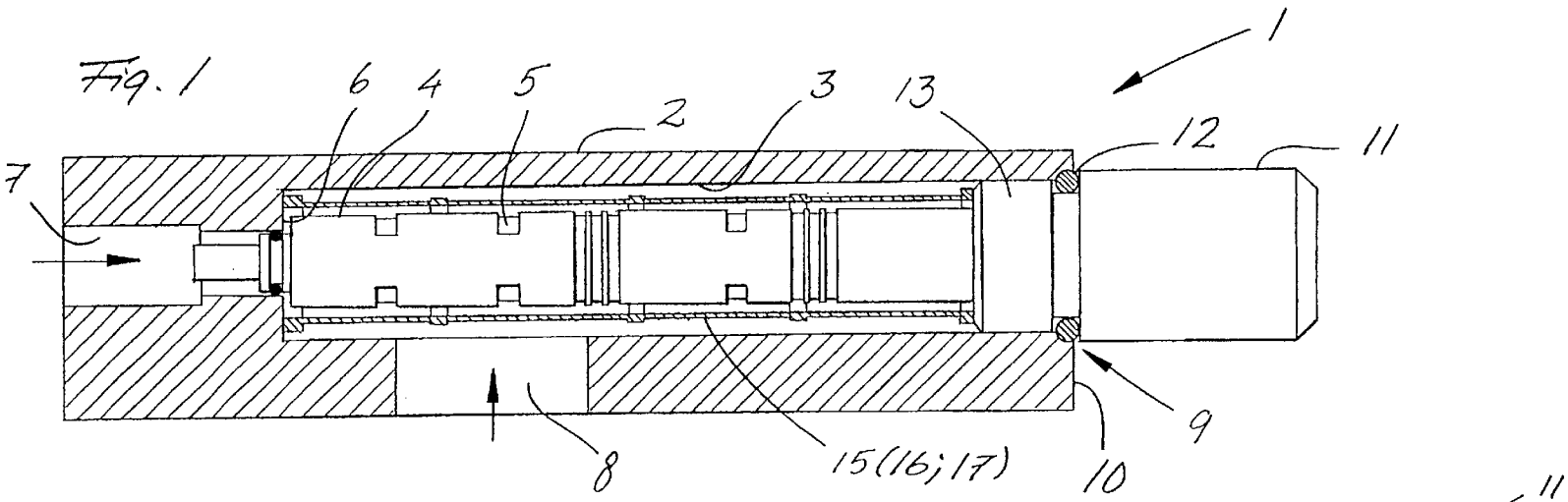

According to this invention, the vacuum pump 1 comprises an ejector pump 4 arranged in a house 2, and more specifically arranged in a vacuum chamber 3, formed in the house. Said ejector pump 4 has a rotationally symmetric body and comprises one or several, internally arranged nozzles arranged in a series, as well as valve means 5 accommodated in the circumferential wall of the ejector body. Preferably, the ejector body is a multi stage ejector having valve seats integrally formed in the ejector body, and the ejector reaches through an inner end or bottom 6 of the vacuum chamber for fluid flow communication with a compressed air inlet 7. The ejector is operated by the compressed air to generate a negative pressure in the surrounding vacuum chamber 3. The latter communicates via a connection 8 with a system assembly (not shown), which is operated by negative pressure.

The sectional shape of the vacuum chamber is not essential to the invention, but is preferably circular at least in the area of the mouth 9, where the vacuum chamber opens axially through the house wall 10. The vacuum chamber 3 may be formed in a separate house 2 that is attachable to the pressure operated assembly, and may alternatively be integrally formed in the material of the assembly in the shape of a blind bore having a depth adapted to the length of the ejector body.

Figure 4:
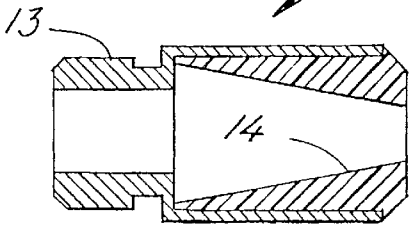
FIG. 4 is a longitudinal section view showing the muffler of FIG. 1.

A muffler 11 is received in the mouth of the vacuum chamber. An O-ring 12, e.g., seals muffler to the vacuum chamber wall in the mouth area. The muffler 11 has a rotationally symmetric section and extends into the vacuum chamber by an inner end 13. The inner end 13 is formed to enclose the forward end, i.e. the nozzle of the ejector pump 4, from where the air is discharged through the muffler. Outwardly of the ejector pump, the internal section of the muffler tapers in a frusto-conical shape towards the muffler mouth, as can be seen in FIG. 4.

The internal section, formed by a porous and silencing material is provided by a separate insert 14 that is mounted in a muffler casing made from a resistant material. The skilled man will understand how the muffler may be formed and dimensioned in order to hold the muffler in the mouth of the vacuum chamber by the negative pressure generated therein. Alternatively, threads or other fixations may be used for holding the muffler in place.

Figure 2:
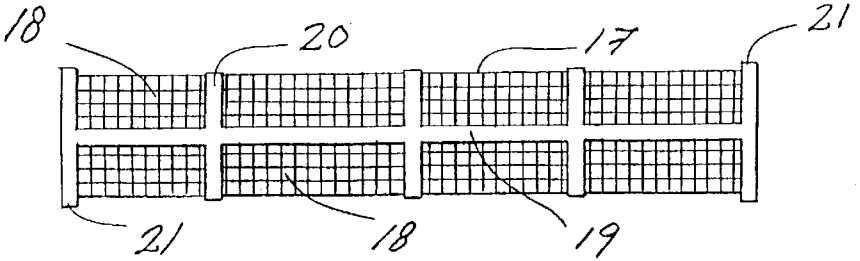
FIG. 2 illustrates a frame associated with the dust filter.
Figure 3:
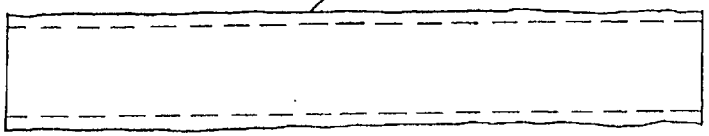
FIG. 3 illustrates a filter body of the dust filter.

In the vacuum chamber 3, the ejector body 4 is circumferentially enclosed by a concentrically about the ejector body extended dust filter 15, see also FIG. 2, that runs substantially about the whole length of the ejector body. The dust filter 15 comprises a tube formed filter body 16 made from a porous material, and may be externally supported by a cylindrical frame 17. In the attached position, the frame and the filter body provides a self containing, rotationally symmetric unit that extends from the bottom 6 of the vacuum chamber to the inner end of the muffler 11, situated in the mouth of the vacuum chamber.

Alternatively, the filter body alone is self containing, and may be formed from a ceramic material, e.g. a sintered ceramic material, a synthetic material or formed as a sintered metal body, that is supported on the ejector body to be extended substantially about the whole length of the ejector body.

Preferably, the frame 17 is formed from a synthetic material, e.g. plastic or a nylon material. In the cylinder wall, the frame is formed to have areas 18 of perforations or apertures, as well as longitudinal and transversal reinforcements 19,20 with no perforations or apertures. Collar formed shoulders 21 are formed in the ends of the frame, adapted to abut the bottom 6 of the vacuum chamber and the inner end of the muffler 11, respectively, in the attached position.

The frame and the filter may alternatively be integrally formed. Such embodiment may be achieved by incorporating a cylindrical filter body with the frame in a moulding process.

Above, the invention is disclosed by way of example, to which modifications are possible without leaving the inventive teachings. A central feature of the invention is the cylindrical filter body, running concentrically about substantially the whole length of the ejector body.

What is claimed is:

1. A filter for a vacuum pump having a rotationally symmetric ejector body (4), designed to generate a negative pressure in a chamber and opening axially through a wall of the chamber, the filter (15) comprising a tube shaped filter body (16), characterized in that the tube shaped filter (15) is self containing and supported on the rotationally symmetric ejector body of the vacuum pump so as to extend concentric about substantially the whole length of the ejector body, to be axially fixed by a muffler (11) that receives the circumferential nozzle end of the ejector body.

2. The filter of claim 1, characterized by a filter body (16) made from a porous material, closely surrounded by a rigid and perforated frame (17) for providing a self-containing unit.

3. The filter of claim 2, characterized in that the frame (12) has a perforated cylinder wall with apertures and longitudinal and transverse reinforcements (19,20), the ends of the frame having collar shaped shoulders (21) for supporting the filter concentric about the ejector body in attached position.

4. The filter of claim 1, characterized by a filter body (16) made from a ceramic material.

* * * * *